US005265364A

United States Patent [19]

Nelson et al.

[11] Patent Number: 5,265,364

[45] Date of Patent: Nov. 30, 1993

[54] INTERLOCKING PLASTIC DISPLAY

[75] Inventors: Kenneth W. Nelson, 15 Beach St., Staten Island, N.Y. 10304; Stanley L. Roggenburg, Staten Island, N.Y.

[73] Assignee: Kenneth W. Nelson, Staten Island, N.Y.

[21] Appl. No.: 884,022

[22] Filed: May 18, 1992

Related U.S. Application Data

[63] Continuation of Ser. No. 534,447, Jun. 6, 1990, abandoned.

[51] Int. Cl.[5] ..... G09F 7/16

[52] U.S. Cl. ..... 40/616; 428/187

[58] Field of Search ..... 40/159.2, 615, 616, 40/618; 264/245, 246, 247; 428/187

[56] References Cited

U.S. PATENT DOCUMENTS

| | | | |
|---|---|---|---|
| 2,586,978 | 2/1952 | Murray | 40/616 X |
| 2,607,957 | 8/1952 | Danielson et al. | 264/247 X |
| 2,609,570 | 9/1952 | Danielson et al. | 264/247 X |
| 2,663,910 | 12/1953 | Danielson et al. | 264/247 |
| 3,973,344 | 8/1976 | Frankel | 40/159.2 |
| 4,835,890 | 6/1989 | Nelson et al. | 40/616 |

FOREIGN PATENT DOCUMENTS

| | | | |
|---|---|---|---|
| 685004 | 4/1964 | Canada | 40/159.2 |
| 1070202 | 7/1954 | France | 40/616 |

*Primary Examiner*—Kenneth J. Dorner
*Assistant Examiner*—Brian K. Green
*Attorney, Agent, or Firm*—Roger S. Thompson

[57] ABSTRACT

A display device has two interlocked contrasting elements. A display element includes indicia and a first locking member. The background element includes a second locking member complementarily shaped to conform to the shape of the first locking member. The first locking member has two portions. The first portion is a waffle plate which tapers from top to bottom. The second portion includes a plurality of frusto-conical pads disposed beneath nodes of the waffle plate of the second portion.

16 Claims, 2 Drawing Sheets

INTERLOCKING PLASTIC DISPLAY

This is a continuation of co-pending application Ser. No. 07/534,447 filed on Jun. 6, 1990, now abandoned.

BACKGROUND OF THE INVENTION

The present invention relates to interlocking plastic displays and, more particularly, to interlocking plastic displays having improved stability.

In our earlier patent, U.S. Pat. No. 4,835,890, the disclosure of which is hereby incorporated by reference, we disclosed an interlocking plastic display having two interlocking members. A first, display, member includes indicia formed therein, and a first locking element formed beneath the indicia. The second, background, member, includes a second locking element configured to interlock with the first locking element. The first locking element includes a portion of reduced depth, so that the first and second locking elements may interlock, with portions of each locking element underlying portions of the other locking element. The two members are made of different colored materials, so that they offer good contrast and ease of readability.

The patented device has proven to work quite well for its intended purpose, but some problems have arisen in the field. When working with larger signs, we have noticed that some warping in the device may develop, and that the manufacture of such larger devices may result in some production difficulties, such as uneven flow of material in the two-shot injection molding process.

We have discovered that these larger display devices benefit from increased strength and resistance to warping provided by an additional layer of locking and supporting elements.

OBJECTS AND SUMMARY OF THE INVENTION

Accordingly, it is an object of the invention to provide an interlocking plastic display which overcomes the drawbacks of the prior art.

It is a further object of the invention to provide an interlocking plastic display having improved structural rigidity.

It is a still further object of the invention to provide an interlocking plastic display having additional layers of locking and supporting elements.

Briefly stated, there is provided a display device which has two interlocked contrasting elements. A first, display, element includes indicia and a first locking member. The second, background, element includes a second locking member complementarily shaped to conform to the shape of the first locking member. The first locking member has two portions. The first portion is a waffle plate which tapers from top to bottom. The second portion includes a plurality of frusto-conical pads disposed beneath nodes of the waffle plate of the second portion.

In accordance with these and other objects of the invention, there is provided a display device comprising: a display member having a top surface and a bottom surface, said display member including indicia disposed on said top surface, and further including first locking means disposed beneath said top surface; and a background member also having a top surface and a bottom surface, said background member including second locking means configured to interlock with said first locking means; said first locking means having first and second portions, each with top and bottom surfaces and a horizontal cross-section; said bottom surface of said first portion overlying at least part of said top surface of said second portion; said cross-section of said second portion being smaller than said cross-section of said first portion; said second locking means substantially underlying at least one of said first and second portions of said first locking means; whereby said display member and said background member are locked together by the interlocking of said first and second locking means.

According to a feature of the invention, there is further provided a display device comprising a display member having a top surface and a bottom surface, said display member including indicia disposed on said top surface, and further including first locking means disposed beneath said top surface; and a background member also having a top surface and a bottom surface, said background member including second locking means configured to interlock with said first locking means; said first locking means having a waffle plate with a top surface, a bottom surface and a horizontal cross-section; said first locking means further having a plurality of pads, each having a top surface and an overall horizontal cross-section; said bottom surface of said waffle plate overlying at least part of said top surface of said plurality of pads; said cross-section of said plurality of pads being smaller than said cross-section of said waffle plate; said second locking means substantially underlying a portion of said first locking means; whereby said display member and said background member are locked together by the interlocking of said first and second locking means.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
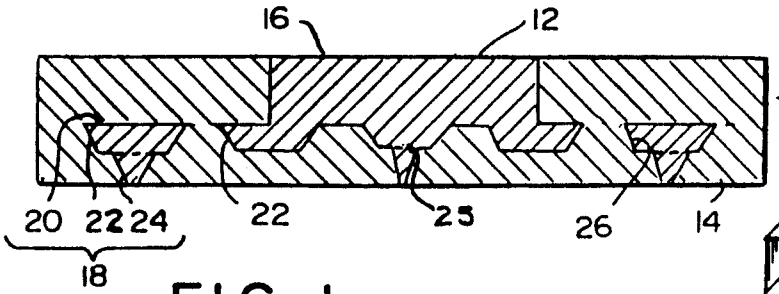
FIG. 1 is a vertical cross-section of a display device according to the invention.

Referring now to FIG. 1, there is shown, generally at 10, a display device in accordance with the invention.

Display device 10 includes a display member 12 and a background member 14. The composition and possible methods of manufacture of inventive display device 10 are essentially the same as described in our earlier referenced patent, and so are not further described in detail here.

As shown in FIG. 1, display member 12 includes three distinct layers, or portions. The uppermost portion of display member 12 comprises indicia 16. The lower portions together comprise a first locking element 18.

First locking element 18 includes an upper portion 20, having a tapered side wall 22, and a lower portion 24. A dashed line 25 indicates the separation of the upper portion 20 and lower portion 24, as well as the demarcation of the bottom surface of upper portion 20 and the upper surface of lower portion 24.

In the preferred embodiment, depicted in FIG. 1, background member 14 is configured to complement the structure of display member 12, so that display device 10 has a generally rectangular overall vertical cross-section. This is not the only possible embodiment, however.

In other embodiments, not separately shown, background member 14 may not completely encapsulate the sides of display member 12, but rather may be co-terminous therewith. Furthermore, the top of display member 12 and background member 14 need not be co-planar. The possible alternative embodiments are also discussed in our earlier patent, and so are not discussed further here.

The primary difference between the device disclosed in our earlier patent and the instant device relates to the configuration of first locking element 18 hereof, and so the following discussion will be directed to that element. While background member 14 includes a second locking element 26 which differs from the analogous member of our patented device, the shape thereof is determined by the shape of first locking element 18, so no separate discussion thereof is believed necessary.

Figure 2:
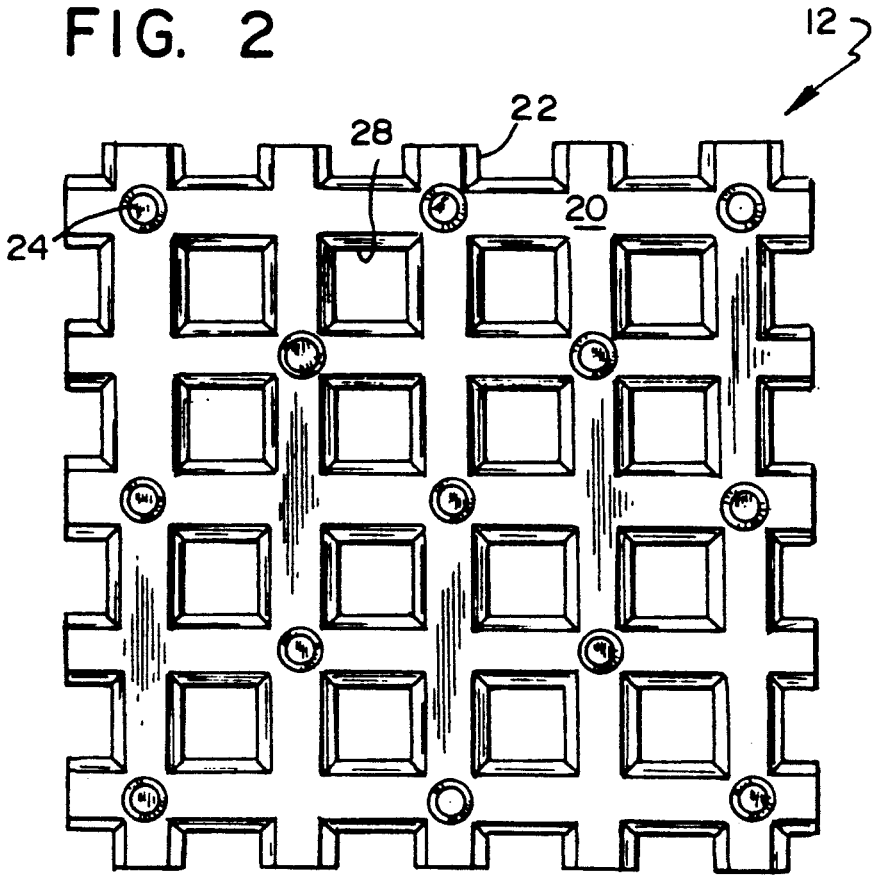
FIG. 2 is a bottom plan of the display member of the device of FIG. 1.

Turning now to FIG. 2, first locking element 18 is shown in further detail. FIG. 2 is a bottom plan view of display member 12, with indicia 16 omitted, for clarity. While indicia 16 and the remainder of display member 12 are described as though they are discrete components, it will be appreciated that, in fact, they together comprise a single, unitary element, in the preferred embodiment.

Upper portion 20 is preferably formed as a waffle plate, having generally square passages 28 therein. The overall appearance of first locking element 18, when viewed from the top, resembles that of a waffle iron.

Upper portion 20 is generally similar to the first locking means described in our earlier patent. The difference is the addition of lower portion 24.

Figure 3:
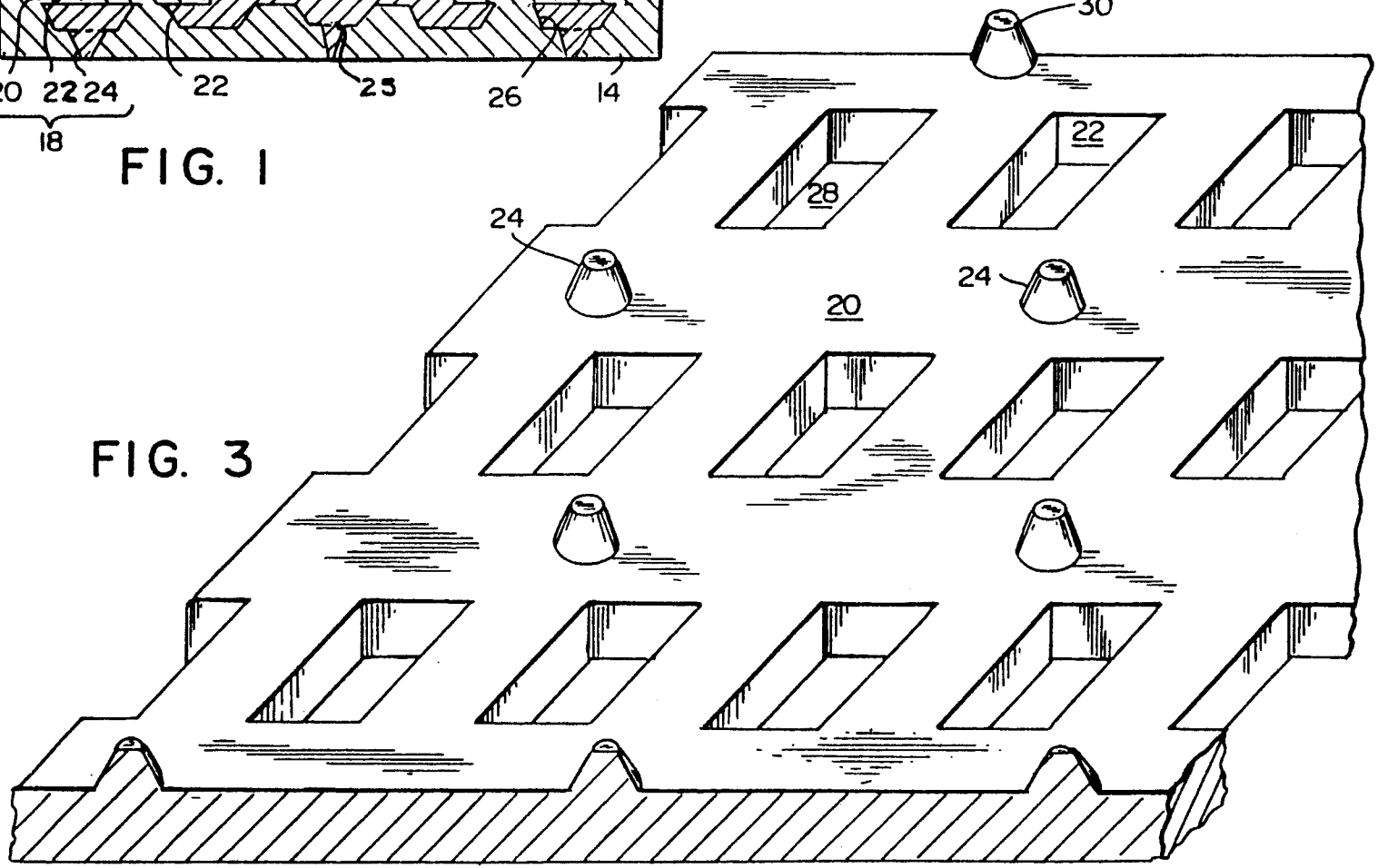
FIG. 3 is bottom perspective of a portion of the display member of FIG. 2, shown partly in cross-section.

Lower portion 24 has a total cross-section substantially smaller than that of upper portion 20. As illustrated, in the most preferred embodiment, lower portion 24 comprises a plurality of pads. It is further preferred that the pads of lower portion 24 be formed as frustoconical pads (see FIG. 3). In the preferred embodiment, passages 28 are approximately 0.090" on each side, with an eighteen degree (18°) taper per side, with the distance between adjacent passages set at 0.1875". Pads 30 are preferably 0.062" high, with a ten degree (10°) taper. The widest diameter of pads 30 is approximately 0.125", and thus the smallest diameter would be approximately 0.103".

Display device 10 is preferably manufactured in a molding operation in which display member 12 is formed, and then placed in a mold where the material comprising background member 14 is injected. That material flows about display member 12, substantially encapsulating it. However, the bottom of lower portion 24 and the top of indicia 16 contact the opposing sides of the mold, so that indicia 16 are not covered by the flowing material, and remain visible. Since lower portion 24 has such a relatively small cross-section, more of background member 14 flows under display member 12; thereby imparting greater structural resistance to warping.

It will be appreciated that the illustrated design is not the only possible configuration of the invention. For example, it is possible that the presence of the regular rectilinear structure of first portion 20 may lead to the creation of a weakness in the structure of a large sign. It could cause a "bend line", facilitating deformation of the display member along a single line. Alternative constructions, not illustrated, could overcome this.

For example, instead of forming upper portion 20 as a rectangular waffle plate, it could be formed hexagonally, resembling a honeycomb, or with circular aperture therein.

Figure 4:
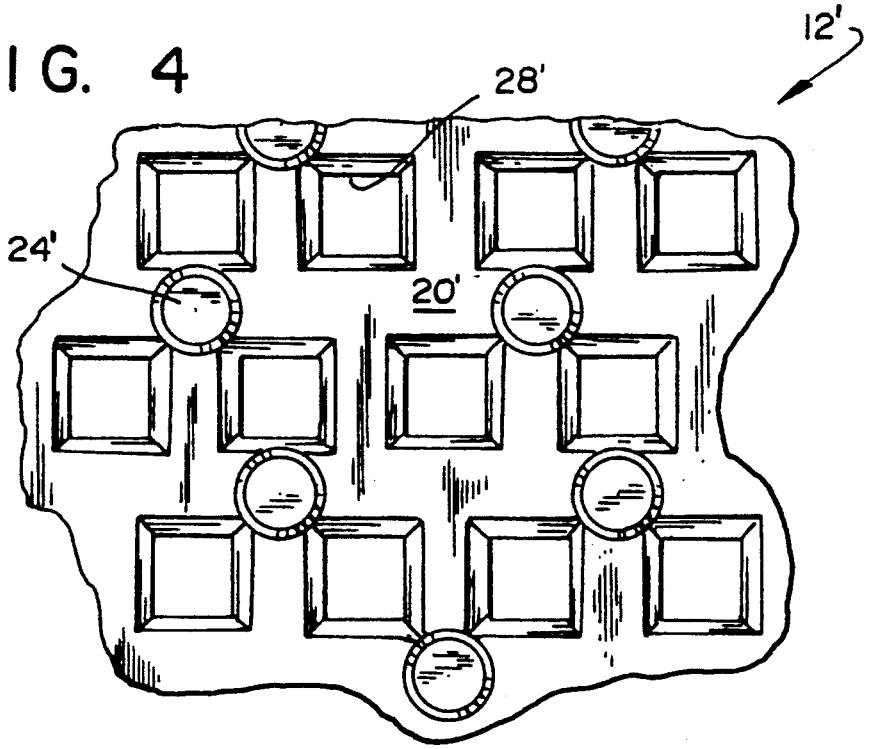
FIG. 4 is a bottom plan of a portion of a secondary embodiment of the display member of the invention.

As another alternative, alternate rows of a rectilinear structure may be offset. This embodiment is shown in FIG. 4, where elements similar to those of the preferred embodiment are denominated by primes. Such a construction would be more difficult and expensive to realize, but would probably be best performed in known fashion by electric discharge machining.

Many other, different, configurations may be best for different applications, and some minor experimentation may be useful to determine the best arrangement for any specific application.

Similarly, the number and positioning of pads 30 may vary depending on the application. The addition of pads 30 to the display device of our prior patent provides the superior strength which may be found in the instant device. The illustrated embodiment shows pads 30 positioned at alternating nodes 31 of upper portion 20. This positioning maximizes the surface area of pads 30 which contact upper portion 20, while minimizing the amount of volume to be removed from the mold which is used to form display member 12. In placing pads 30 in the desired structure, it is important to exceed a minimum diameter on the surface of pad 30 which contacts upper portion 20 to facilitate the molding process, while also maintaining a degree of integrity of the shape of pads 30 during the remainder of the molding process during which background member 14 is fabricated. If too many pads 30 are used, the cost of the mold will be increased, and the flow of the molded background material could be impeded. All of the application-specific parameters would be easily understood and implemented by the ordinary artisan skilled in the practice of injection molding, and so no further specific teachings thereon are believed necessary.

It is believed that the number and shape of pads 30 should be calculated so that the total volume of pads 30 is approximately equal to the total volume of the material which forms indicia 16. This will tend to equalize the flow of background material about display member 12, thereby minimizing warpage.

Having described preferred embodiments of the invention with reference to the accompanying drawings, it is to be understood that the invention is not limited to those precise embodiments, and that various changes and modifications may be affected therein by one skilled in the art without departing from the scope or spirit of the invention as defined in the appended claims.

What is claimed is:

1. A display device comprising:

a display member having a top surface and a bottom surface, said display member including indicia disposed on said top surface, and further including first locking means disposed beneath said top surface; and a background member also having a top surface and a bottom surface, said background member including second locking means configured to interlock with said first locking means;

said first locking means including an upper portion, having a top surface, a bottom surface and a predetermined horizontal cross-section, and a lower portion, having a top surface, a bottom surface and a predetermined horizontal cross-section, each of said upper portion and said lower portion of said first locking means interlocking with said second locking means;

wherein said predetermined horizontal cross-sections each lie in a plane generally parallel to said top surface of said display member;

said predetermined horizontal cross-section of said lower portion being smaller in said plane parallel to said top surface of said display member than said predetermined horizontal cross-section of said upper portion;

said bottom surface of said upper portion of said first locking means overlying at least part of said top surface of said lower portion;

said second locking means substantially underlying at least one of said upper and lower portions of said first locking means; and wherein a portion of said top surface of said background member overlies a portion of said display member;

whereby said display member and said background member are locked together by the interlocking of said first and second locking means, particularly by said underlying of said at least one of said upper and lower portions of said first locking means by said second locking means, and by said overlying of said portion of said display member by said portion of said background member.

2. The display device of claim 1, wherein said lower portion of said first locking means comprises a plurality of pads, each disposed below said bottom surface of said upper portion, said pads interlocking with said second locking means.

3. The display device of claim 2, wherein said pads are frusto-conically shaped.

4. The display device of claim 2, wherein the total volume of said indicia is approximately equal to the total volume of said plurality of pads.

5. The display device of claim 1, wherein said upper portion includes a waffle plate.

6. The display device of claim 5, wherein said waffle plate is substantially rectilinear.

7. The display device of claim 5, wherein said lower portion comprises a plurality of pads, each underlying nodes of said waffle plate.

8. The display device of claim 7, wherein said pads are frusto-conically shaped.

9. The display device of claim 5, wherein the total volume of said indicia is approximately equal to the total volume of said lower portion of said first locking means.

10. The display device of claim 1, wherein the total volume of said indicia is approximately equal to the total volume of said lower portion of said first locking means.

11. The display device of claim 1, wherein said top surface of said upper portion of said first locking means is connected to said bottom surface of said upper portion of said first locking means by a tapered portion.

12. A display device comprising:

a display member having a top surface and a bottom surface, said display member including indicia disposed on said top surface, and further including first locking means disposed beneath said top surface; and a background member also having a top surface and a bottom surface, said background member including second locking means configured to interlock with said first locking means;

said first locking means having a waffle plate with a top surface, a bottom surface and a predetermined horizontal cross-section;

said first locking means further having a lower section, having a top surface, a bottom surface, and a predetermined horizontal cross-section, said bottom surface of said waffle plate being disposed closer to the top surface of said display member than said bottom surface of said lower section;

wherein said predetermined horizontal cross-sections each lie in a plane generally parallel to said top surface of said display member;

said lower section including a plurality of pads, each having a top surface and also having a predetermined horizontal cross-section;

said bottom surface of said waffle plate overlying at least part of said top surface of said lower section;

said predetermined horizontal cross-section of said lower section being smaller in said plane parallel to said top surface of said display member than said predetermined horizontal cross-section of said waffle plate;

said second locking means substantially underlying a portion of said first locking means;

said plurality of pads interlocking with said second locking means; and wherein a portion of said top surface of said background member overlies a portion of said display member;

whereby said display member and said background member are locked together by the interlocking of said first and second locking means, particularly by said underlying of said portion of said first locking means by said second locking means, by said interlocking of said plurality of pads with said second locking means, and by said overlying of said portion of said display member by said portion of said background member.

13. The display device of claim 12, wherein said pads are frusto-conically shaped.

14. The display device of claim 12, wherein the total volume of said indicia is approximately equal to the total volume of said plurality of pads.

15. The display device of claim 12, wherein said waffle plate is substantially rectilinear.

16. The display device of claim 12, wherein at least some of said plurality of pads each underlie nodes of said waffle plate.

* * * * *